US007545340B2

(12) United States Patent
Takaoka et al.

(10) Patent No.: US 7,545,340 B2
(45) Date of Patent: Jun. 9, 2009

(54) COMPACT ANTENNA HAVING COAXIAL HELICAL ELEMENTS WITH ENDS CONNECTED ACROSS AN RF SIGNAL SOURCE

(75) Inventors: Akira Takaoka, Okazaki (JP); Noriaki Okada, Chiryu (JP)

(73) Assignees: Denso Corporation, Kariya, Aichi-Pref. (JP); Nippon Soken, Inc., Nishio, Aichi-Pref. (JP)

( * ) Notice: Subject to any disclaimer, the term of this patent is extended or adjusted under 35 U.S.C. 154(b) by 0 days.

(21) Appl. No.: 11/476,197

(22) Filed: Jun. 28, 2006

(65) Prior Publication Data

US 2006/0290590 A1 Dec. 28, 2006

(30) Foreign Application Priority Data

Jun. 28, 2005 (JP) ..... 2005-188513
Apr. 7, 2006 (JP) ..... 2006-106787

(51) Int. Cl.
*H01Q 1/36* (2006.01)
*H01Q 1/24* (2006.01)

(52) U.S. Cl. ..... 343/895; 343/702

(58) Field of Classification Search ..... 343/895, 343/702, 793
See application file for complete search history.

(56) References Cited

U.S. PATENT DOCUMENTS

| | | | | |
|---|---|---|---|---|
| 4,270,128 | A * | 5/1981 | Drewett | 343/702 |
| 5,982,330 | A * | 11/1999 | Koyanagi et al. | 343/702 |
| 6,952,186 | B2 * | 10/2005 | Saito et al. | 343/702 |
| 2002/0055336 | A1 * | 5/2002 | Hong | 455/90 |
| 2003/0169209 | A1 * | 9/2003 | Ohara et al. | 343/895 |

FOREIGN PATENT DOCUMENTS

| | | |
|---|---|---|
| JP | 2002-171127 | 6/2002 |
| JP | 2003-152427 | 5/2003 |

* cited by examiner

*Primary Examiner*—Hoang V Nguyen
*Assistant Examiner*—Robert Karacsony
(74) *Attorney, Agent, or Firm*—Nixon & Vanderhye PC

(57) ABSTRACT

An antenna includes outer and inner elements, one of which is a signal line and the other of which is a ground line. Each of the outer and inner elements is a helical element having helical portions. The inner element is arranged inside the outer element such that the outer and inner elements are spaced from each other. An axis of the outer element is parallel to that of the inner element.

9 Claims, 7 Drawing Sheets

RRIOR ART

RRIOR ART

COMPACT ANTENNA HAVING COAXIAL HELICAL ELEMENTS WITH ENDS CONNECTED ACROSS AN RF SIGNAL SOURCE

CROSS REFERENCE TO RELATED APPLICATION

This application is based on and incorporates herein by reference Japanese Patent Applications No. 2005-188513 filed on Jun. 28, 2005 and No. 2006-106787 filed on Apr. 7, 2006.

FIELD OF THE INVENTION

The present invention relates to a small antenna.

BACKGROUND OF THE INVENTION

In a wireless device (e.g., a keyless entry receiver) for home or vehicle use, radio waves having a relatively long wavelength from a few tens of centimeters to a few meters are used. For example, the wireless device generally uses ultrahigh frequency waves (UHF) or very high frequency waves (VHF). Therefore, size of the wireless device depends on size of an antenna used in the wireless device and the size of the antenna needs to be reduced to reduce the size of the wireless device.

A small antenna is disclosed in, for example, JP-A-2003-152427. The antenna includes a straight inner conductor and a helical outer conductor wound around the inner conductor with a space. The antenna resonates at a specified frequency. The antenna has a relatively high gain in spite of the fact that the antenna has a small and simple structure.

In the antenna, it is difficult to reduce the size of the antenna below a predetermined level. For example, when the antenna is reduced in length or width, the inner conductor or the outer conductor needs to be increased in height to obtain an electrical length for allowing the antenna to resonate. However, because the inner conductor is straight, the antenna is greatly increased in height if the inner conductor is increased in height.

SUMMARY OF THE INVENTION

In view of the above-described problem, it is an object of the present invention to provide a small antenna.

An antenna includes outer and inner elements, one of which is a signal line and the other of which is a ground line. Each of the outer and inner elements is a helical element having helical portions. The inner element is arranged inside the outer element such that the outer and inner elements are spaced from each other. An axis of the outer element is parallel to that of the inner element.

When the antenna transmits or receives radio waves, a first current flows through the outer element and a second current flows the inner element. In this case, the first current generates an image current around the inner element. In the antenna, because the inner element is the helical element, the image current and the second current flow in almost the same direction (vector). Therefore, the second current and the image current are combined efficiently. The helical current path of the inner element prevents an unwanted current from flowing therethrough.

Thus, the antenna has a narrow bandwidth so that a gain of the antenna can be increased. Therefore, the antenna having the helical inner element can have a smaller size than a conventional antenna having a straight inner element, when each antenna has almost the same gain.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

Figure 1:
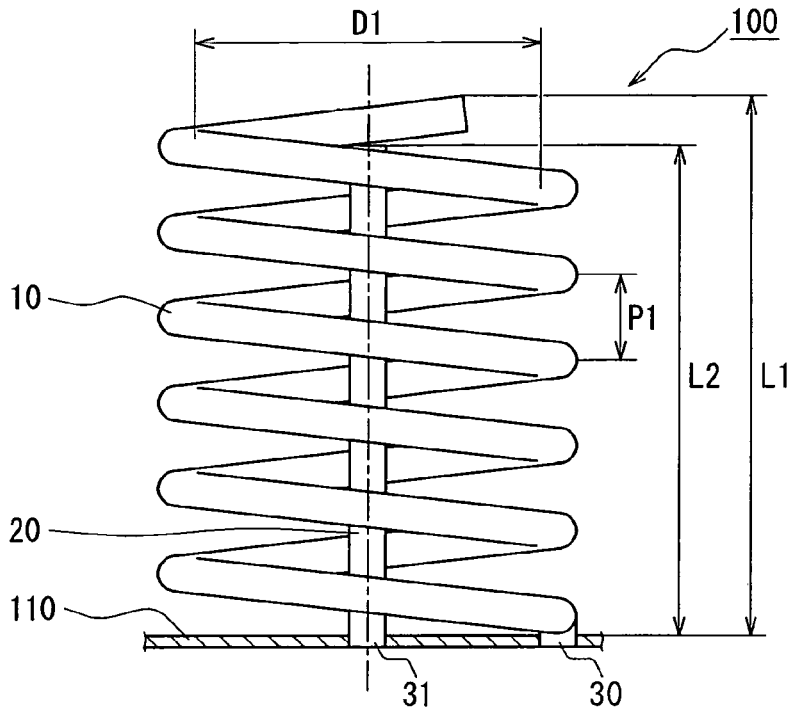
FIG. 1 PRIOR ART
FIG. 1 is a schematic view of a conventional antenna.

Using a finite difference time domain (FDTD) method, the present inventors have performed a simulation of current distribution in a conventional antenna 100 shown in FIG. 1. The conventional antenna 100 includes an outer element 10 and an inner element 20. The outer element 10 is a helical element having helical portions and the inner element 20 is a straight element. The inner element 20 is arranged inside the outer element 10 such that the inner element 20 and the outer element 10 are spaced from each other. As indicated by a broken line of FIG. 1, an axis of the outer element 10 coincides with an axis of the inner element 20.

The outer element 10 has a first end portion 30 that is fixed to the circuit board 110 and electrically connected to an amplifier circuit (not shown) through the circuit board 110. Likewise, the inner element 20 has a second end portion 31 that is fixed to the circuit board 110 and electrically connected to the amplifier circuit through the circuit board 110. A feed point of the conventional antenna 100 periodically switches between the first end portion 30 and the second end portion 31 because of a radiofrequency (i.e., high-frequency) current flowing through the outer element 10 and the inner element 20. Accordingly, the ground point of the conventional antenna 100 periodically switches between the first end portion 30 and the second end portion 31.

In FIG. 1, D1 is an inner diameter of the helical portions of the outer element 10, L1 is a height of the inner element 20 from the surface of the circuit board 110, L2 is a height of the outer element 10 from the surface of the circuit board 110, and P1 is a spacing between each of the helical portions of the outer element 10.

Figure 2A:
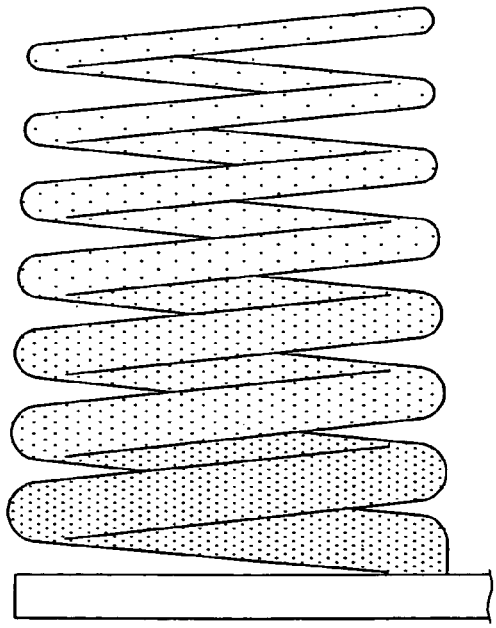
FIG. 2A PRIOR ART
FIG. 2A is a simulation result of current distribution in an outer element of the conventional antenna of FIG. 1.
Figure 2B:
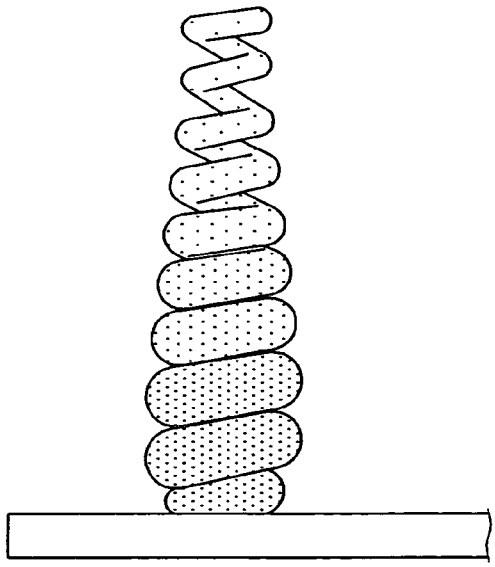
FIG. 2B PRIOR ART
FIG. 2B is a simulation result of current distribution in an inner element of the conventional antenna of FIG. 1.

As a result of the simulation, FIG. 2A shows current distribution in the outer element 10 and FIG. 2B shows current distribution in the inner element 20. As can be seen from FIG. 2B, the current distribution in the inner element 20 results in a helical pattern in spite of the fact that the inner element 20 is the straight element. The helical pattern may be generated in the following manner.

Figure 3A:
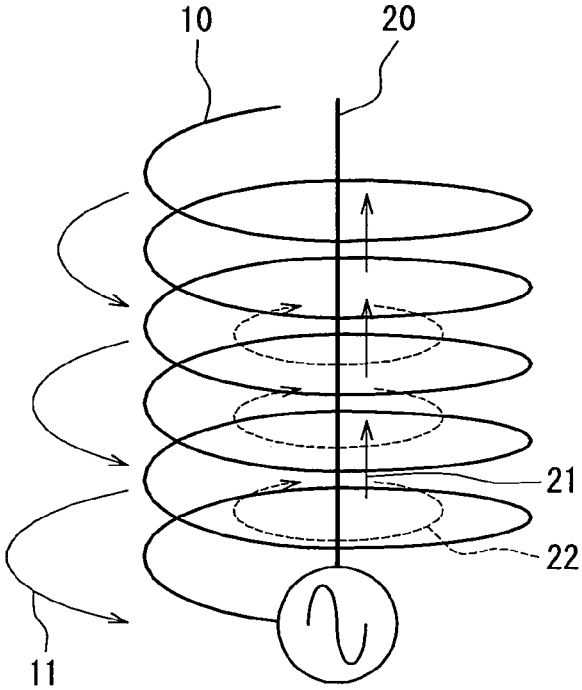
FIG. 3A PRIOR ART
FIGS. 3A and 3B are views showing principles on which the current distribution of FIG. 2B is produced.
Figure 3B:
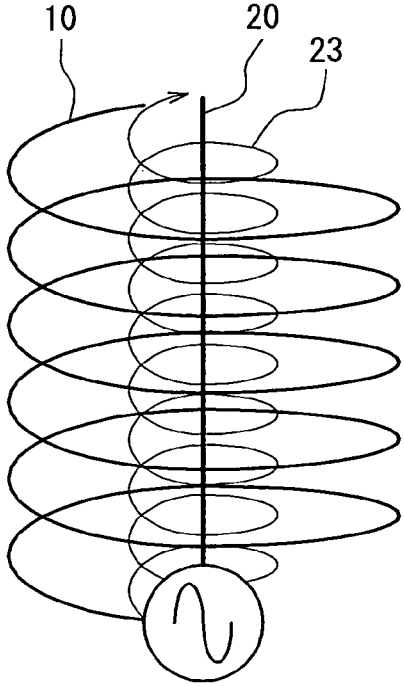
FIG. 3B PRIOR ART

When the conventional antenna 100 transmits or receives radio waves, a first current 11 flows through the outer element 10 and a second current 21 flows through the inner element 20. In this case, the first current 11 generates an image (secondary) current 22 around the inner element 20. The direction of the image current 22 is opposite to that of the first current 11, as shown in FIG. 3A. Then, a helical current 23 shown in FIG. 3B is generated as a combination of the second current 21 and the image current 22 and because of skin effect that occurs at high frequency.

Because the conventional antenna 100 is a dipole antenna, resonance occurs when a total electrical length of the outer element 10 and the inner element 20 corresponds to a multiple of one half wavelength of the radio wave.

It is difficult to reduce the size of the conventional antenna 100 because the inner element 20 is the straight element. For example, when the conventional antenna 100 is reduced in length or width, the outer element or the inner element needs to be increased in height to obtain an electrical length for allowing the conventional antenna 100 to resonate. However, because the inner element 20 is the straight element and has a small surface area, the inner element 20 needs to be greatly increased in height to obtain the electrical length.

By increasing the diameter of the inner element 20, it may be possible to increase the surface area of the inner element 20 and obtain the electrical length. However, contact area between the inner element 20 and the circuit board 110 increases with the increase in the diameter of the inner element 20. Accordingly, various troubles such as a connection failure and a resistance failure tend to occur. Further, because the whole side of the inner element 20 may act as a current path, an unwanted current tend to flow through the inner element 20. As a result, the conventional antenna 100 may have a wide bandwidth and the gain may be reduced.

Figure 4A:
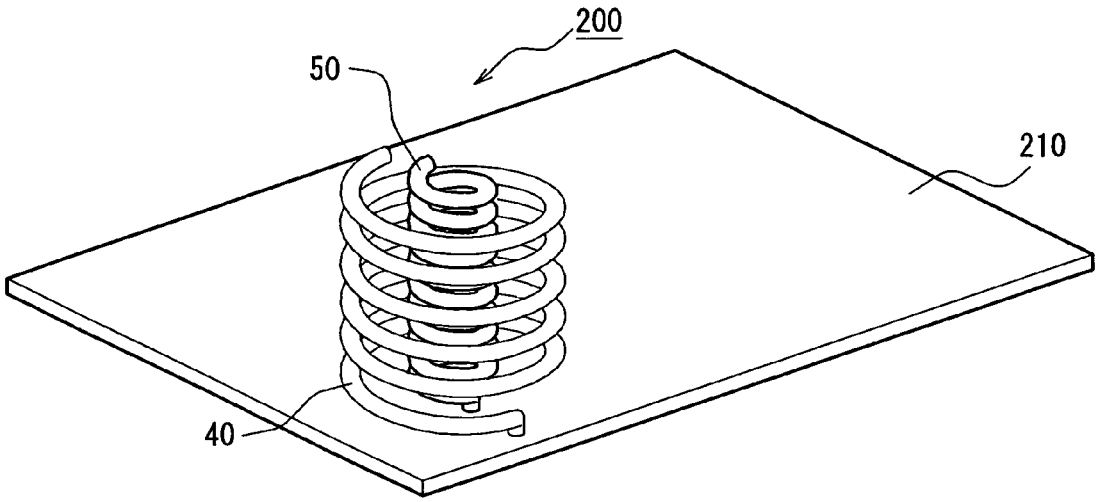
FIG. 4A is a view showing an antenna according to an embodiment of the present invention.

An antenna 200 according to an embodiment of the present invention will now be described with reference to FIGS. 4A and 4B.

The antenna 200 includes an outer element 40 and an inner element 50. Each of the outer element 40 and the inner element 50 is a helical element having helical portions. The inner element 50 is arranged inside the outer element 40 such that the outer element 40 and the inner element 50 are spaced from each other. As indicated by a broken line of FIG. 4B, an axis of the outer element 40 coincides with an axis of the inner element 50.

The outer element 40 has a first end portion 60 that is fixed to a circuit board 210 and electrically connected to a circuit (not shown) such as an amplifier circuit through the circuit board 210. Likewise, the inner element 50 has a second end portion 61 that is fixed to the circuit board 210 and electrically connected to the circuit through the circuit board 210. A feed point of the antenna 200 periodically switches between the first end portion 60 and the second end portion 61 because of a radiofrequency (i.e., high-frequency) current flowing through the outer element 40 and the inner element 50. That is, a balanced RF alternating current circuit has one side connected to outer element 40 and the other side connected to inner element 50. Accordingly, outer element 40 and inner element 50 are simultaneously driven in opposite directions (in a transmit mode) such that, in effect, a ground point of the antenna 200 periodically switches between the first end portion 60 and the second end portion 61.

Figure 4B:
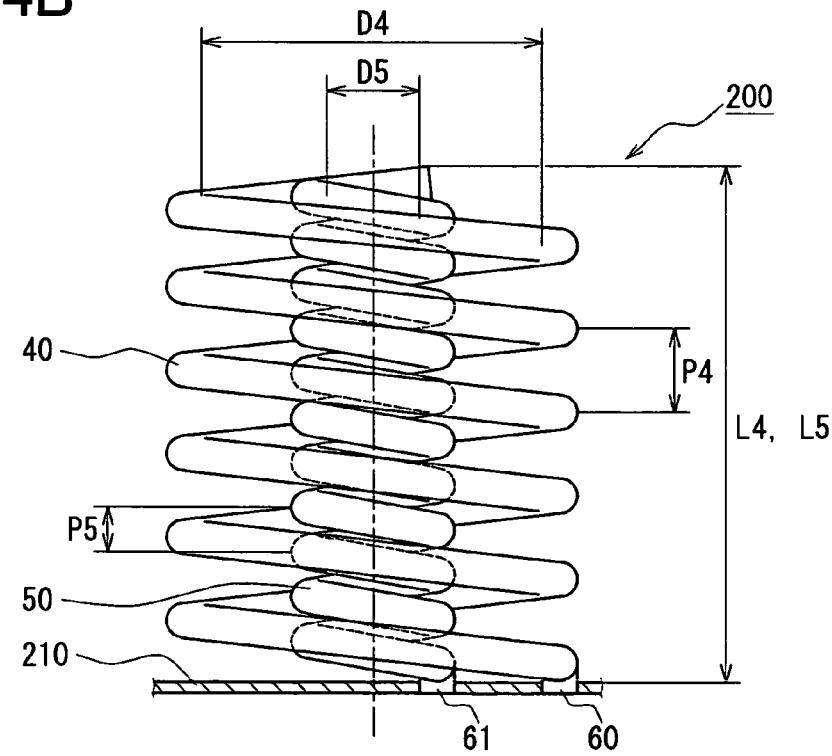
FIG. 4B is an enlarged view of the antenna of FIG. 4A.

In FIG. 4B, D4 is the inner diameter of the helical portions of the outer element 40, D2 is the inner diameter of the helical portions of the inner element 50, L4 is the height of the outer element 40 from the surface of the circuit board 210, L5 is the height of the inner element 50 from the surface of the circuit board 210, P4 is the spacing between each of the helical portions of the outer element 40, and P5 is the spacing between each of the helical portions of the inner element 50.

When the antenna 200 transmits or receives a radio wave, a first current flows through the outer element 40 and a second current flows through the inner element 50. In this case, the first current generates an image (secondary) current around the inner element 50 in the same direction (vector) as the second current. In the antenna 200, therefore, the second current and the image current can be combined into a helical current more efficiently than in the conventional antenna 100. The helical current path of the inner element 50 may prevent an unwanted current from flowing therethrough.

Thus, the antenna 200 has a narrow bandwidth so that a gain of the antenna 200 can be increased. Therefore, when the antenna 200 has almost the same gain as the conventional antenna 100, size of the antenna 200 can be smaller than that of the conventional antenna 100.

The antenna 200 is directly fixed to the circuit board 210, for example, by soldering and electrically connected to the circuit such as the amplifier circuit through the circuit board 210. Thus, the outer and inner elements 40, 50 are connected to the circuit board 210 without a cable so that size of a wireless device having the antenna 200 can be reduced.

The total electrical length of the outer element 40 and the inner element 50 is approximately equal to half the wavelength so that the size of the antenna 200 can be reduced. Alternatively, the total electrical length may be changed as long as the total electrical length allows the antenna 200 to resonate.

As shown in FIG. 4B, the height L4 of the outer element 40 is approximately equal to the height L5 of the inner element 50. Thus, the image current generated by the first current flowing through the outer element 40 acts on the inner element 50 effectively. Therefore, the gain of the antenna 200 can be increased without an increase in the size. Alternatively, the height L4 may be different from the height L5.

Advantages of the antenna 200 will be discussed below. Here, it is assumed that the antenna 200 is used for a vehicular keyless entry receiver that uses a frequency of 312.15 mega hertz (MHz).

Generally, the maximum allowable height of an antenna for the keyless entry receiver is about 18 millimeters (mm). In the conventional antenna 100, the outer element 10 must have the height L2 of 20 mm to obtain the electrical length (i.e., half the wavelength of the frequency) that allows the conventional antenna 100 to resonate at the frequency of 312.15 MHz, when the inner element 20 has the height L1 of 18 mm and the outer element 10 has the inner diameter D1 of 14 mm, six helical portions (i.e., six turns) and the spacing P1 of 3 mm. Therefore, the height of the conventional antenna 100 exceeds 18 mm. In this case, each of the outer element 10 and the inner element 20 is formed from a wire having a diameter of 1.2 mm.

Figure 5A:
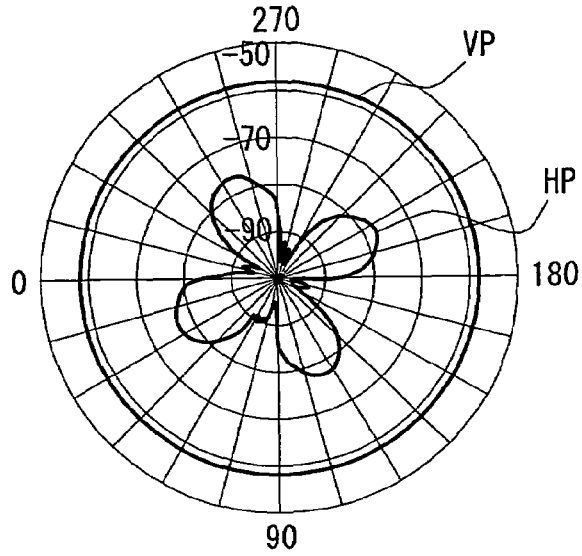
FIG. 5A PRIOR ART
FIG. 5A is a radiation pattern of the conventional antenna of FIG. 1 in the XY-plane.
Figure 5B:
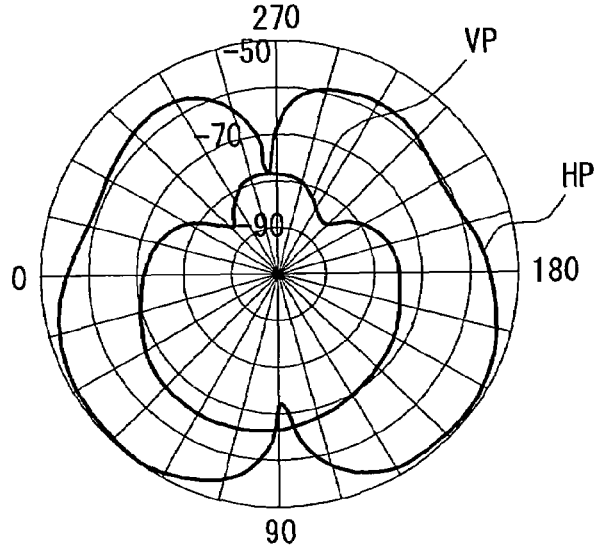
FIG. 5B is a radiation pattern of the conventional antenna of FIG. 1 in the YZ-plane.
Figure 5C:
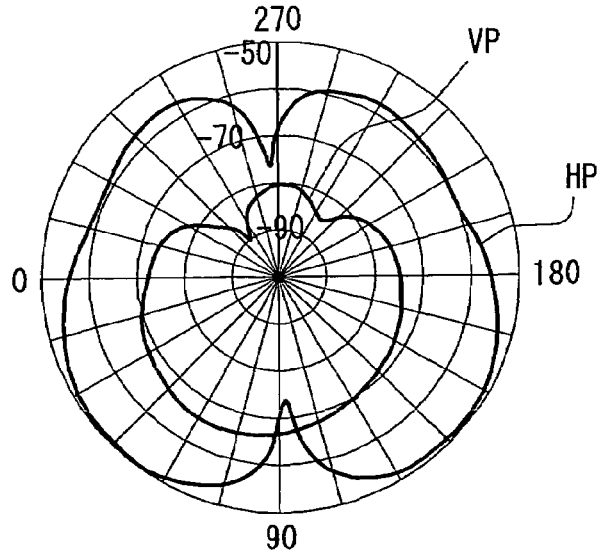
FIG. 5C is a radiation pattern of the conventional antenna of FIG. 1 in the XZ-plane.

FIGS. 5A-5C shows radiation patterns of the conventional antenna 100 having the structure described above. FIGS. 5A-5C indicate the radiation patterns in the XY-plane, YZ-plane, and ZX-plane, respectively. In FIGS. 5A-5C, HP represents a horizontally polarized wave and VP represents a vertically polarized wave.

In the antenna 200, the outer element 40 has a height L4 of 18 mm, an inner diameter D4 of 14 mm, six helical portions and a spacing P4 of 3 mm. The inner element 50 has a height L5 of 18 mm, an inner diameter D5 of 1.5 mm, eleven helical portions (i.e., eleven turns) and a spacing P5 of 1.3 mm. When the antenna 200 has the structure descried above, the electrical length for allowing the antenna 200 to resonate at the frequency of 312.15 MHz can be obtained. Therefore, whole height of the antenna 200 can be less than 18 mm. In this case, each of the outer element 40 and the inner element 50 is formed from a wire having a diameter of 1.2 mm by a bending process.

Figure 6A:
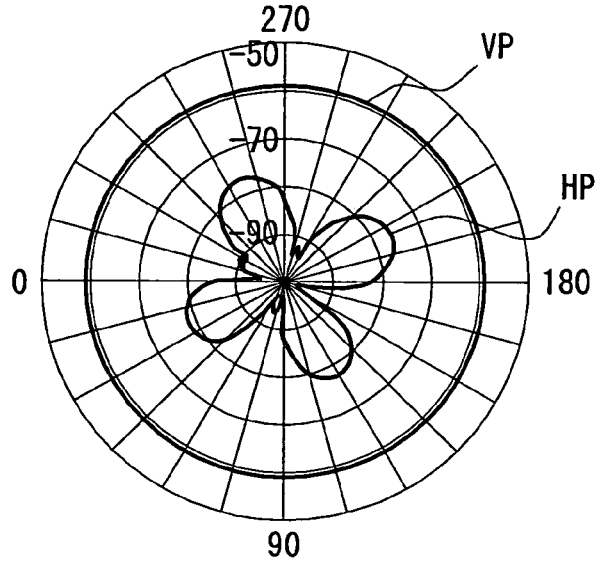
FIG. 6A is a radiation pattern of the antenna of FIG. 4A in the XY-plane.
Figure 6B:
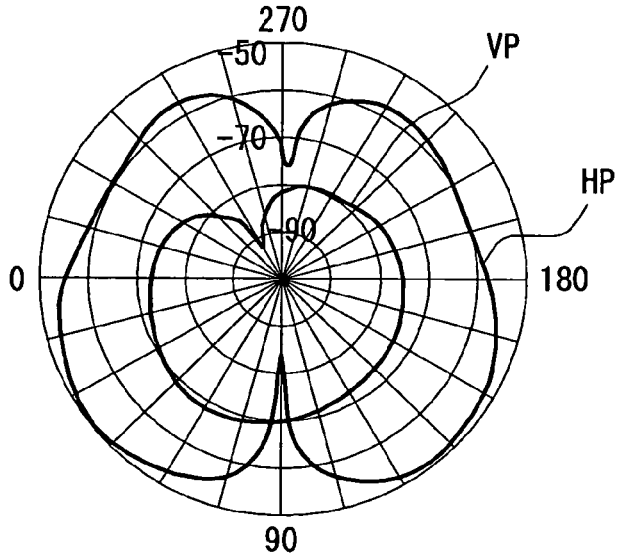
FIG. 6B is a radiation pattern of the antenna of FIG. 4A in the YZ-plane.
Figure 6C:
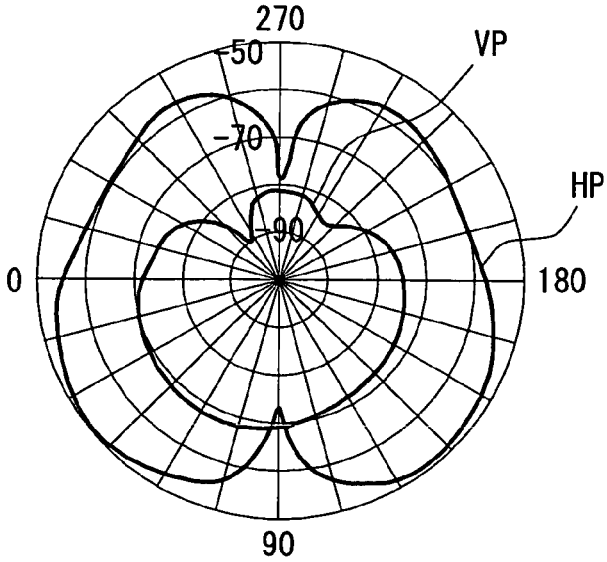
FIG. 6C is a radiation pattern of the antenna of FIG. 4A in the XZ-plane.

FIGS. 6A-6C shows radiation patterns of the antenna 200 having the structure described above. FIGS. 6A-6C indicate the radiation patterns in the XY-plane, YZ-plane, and ZX-plane, respectively. In FIGS. 6A-6C, HP represents a horizontally polarized wave and VP represents a vertically polarized wave.

As can be seen from FIGS. 5A-5C and FIGS. 6A-6C, the radiation patterns of the antenna 200 are almost equal to those of the conventional antenna 100. When it is assumed that the conventional antenna 100 has a gain of 0 dB, the antenna 200 has a gain of minus 0.6 dB. Therefore, whereas the size of the antenna 200 is smaller than that of the conventional antenna 100, the antenna 200 can have the gain that is almost equal to that of the conventional antenna 100.

In the antenna 200, the axis of the outer element 40 coincides with that of the inner element 50. In such an approach, the inner element 50 equally faces the outer element 40 so that the gain of the antenna 200 can be increased. In other words, capacitances are equally generated between the outer element 40 and the inner element 50.

Figure 7:
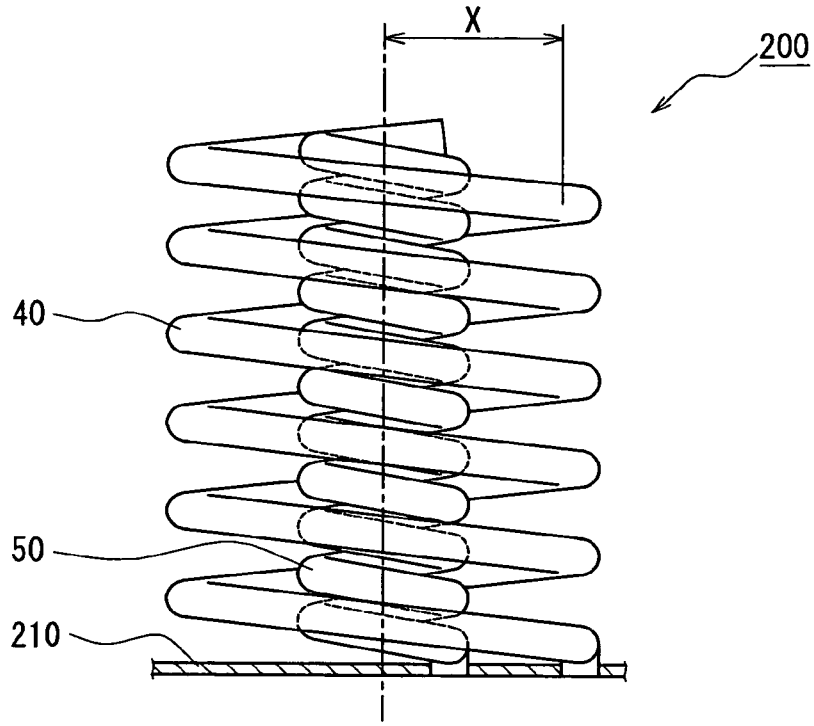
FIG. 7 is a view showing a position of the inner element with respect to the outer element of the antenna of FIG. 4A.

The axis of the inner element 50 may be displaced with respect to that of the outer element 40, as long as the gain of the antenna 200 is maintained at an adequate level. In FIG. 7, X represents a radius (i.e., half the inner diameter D4) of the outer element 40. For example, even when the axis of the inner element 50 is displaced from that of the outer element 40 by about 0.2×, the gain of the antenna 200 is reduced by only about 1 dB.

In the antenna 200, capacitances are generated between the helical portions of the outer element 40 and the helical portions of the inner element 50. Further, in each of the outer element 40 and the inner element 50, capacitances are generated between each of the helical portions. Therefore, characteristics (i.e., resonance and radiation characteristics) of the antenna 200 depend on the spacings P4, P5 and the inner diameters D4, D5, i.e., the position of the inner element 50 with respect to the outer element 40.

The present inventors have discussed about how to improve the gain of the antenna 200. Here, it is assumed that the antenna 200 is used for the keyless entry receiver that uses the frequency of 312.15 MHz. Each of the outer element 40 and the inner element 50 is formed from the wiring having the diameter of 1.2 mm. The axis of the outer element 40 coincides with that of the inner element 50. Each of the height L4 and the height L5 is 18 mm. The inner diameter D4 of the outer element 40 is 14 mm. The gain of the antenna 200 has been measured by using the inner diameter D5 of the inner element 50, the spacing P4 of the outer element 40, and the spacing P5 of the inner element 50 as parameters. In the measurement, an inverted L-type monopole antenna that uses the frequency of 312.15 MHz is used as a reference gain (0 dB).

First, the inner diameter D5 is changed to 3 mm, 4 mm, 6 mm, 8 mm, and 10 mm, under the condition the spacing P4 is fixed to 3 mm and the spacing P5 is fixed to 2 mm. In such an approach, dependence of the gain of the antenna 200 on a ratio of the inner diameter D5 to the inner diameter D4 can be measured.

Figure 8:
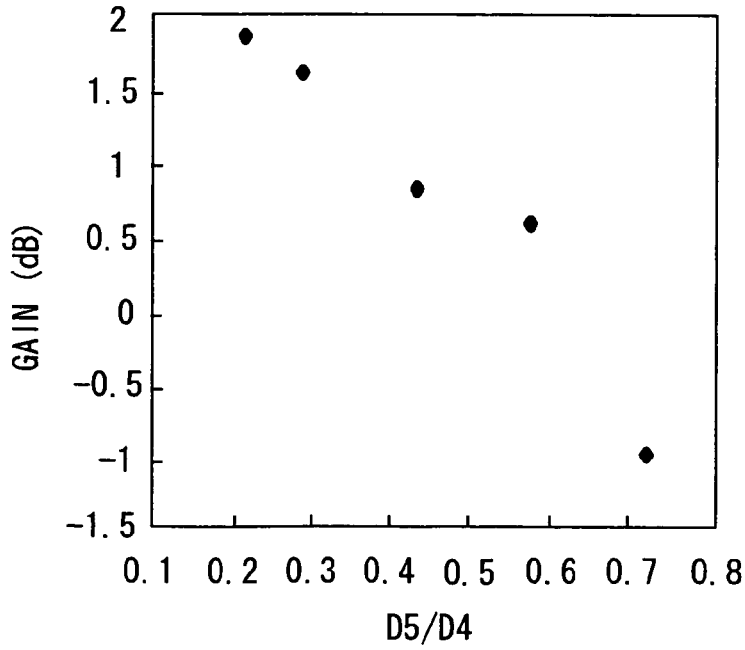
FIG. 8 is a graph showing a relation between a gain and a ratio of an inner diameter of the inner element to an inner diameter of the outer element of the antenna of FIG. 4A.

FIG. 8 is a graph showing the dependence of the gain of the antenna 200 on the ratio of the inner diameter D5 to the inner diameter D4 (i.e., D5/D4). As can be seen from the graph, the gain decreases with an increase in the ratio. As the ratio increases, the distance between the outer element 40 and the inner element 50 is reduced. Therefore, when the current flows through one element, interference caused by the image current generated around the other element may increase. As a result, a total current decreases and the gain of the antenna 200 decreases accordingly. In other words, the capacitances generated between the outer element 40 and the inner element 50 is increased and the amount of radiation decreases.

Therefore, it is preferable to keep the distance between the outer element 40 and the inner element 50 as much as possible. In view of the size reduction of the antenna 200, it is preferable to reduce the inner diameter D5 of the inner element 50 rather than to increase the inner diameter D4 of the outer element 40.

As shown in FIG. 8, when the ratio of the inner diameter D5 to the inner diameter D4 is between 0.3 and 0.6, the gain of the antenna 200 is increased by about 1 dB, as compared to when the ratio exceeds 0.6. When the ratio is lower than 0.3, the gain of the antenna 200 is increased by about 2 dB, as compared to when the ratio exceeds 0.6.

Next, the spacing P4 is changed to 2 mm, 2.25 mm, 2.5 mm, 2.75 mm, and 3 mm, under the condition the inner diameter D5 is fixed to 3 mm and the spacing P5 is fixed to 2 mm. Likewise, the spacing P4 is changed to 2 mm, 2.25 mm, 2.5 mm, 2.75 mm, and 3 mm, under the condition the inner diameter D5 is fixed to 3 mm and the spacing P5 is fixed to 2.5 mm. Likewise, the spacing P4 is changed to 2 mm, 2.25 mm, 2.5 mm, 2.75 mm, and 3 mm, under the condition the inner diameter D5 is fixed to 3 mm and the spacing P5 is fixed to 3 mm.

Figure 9:
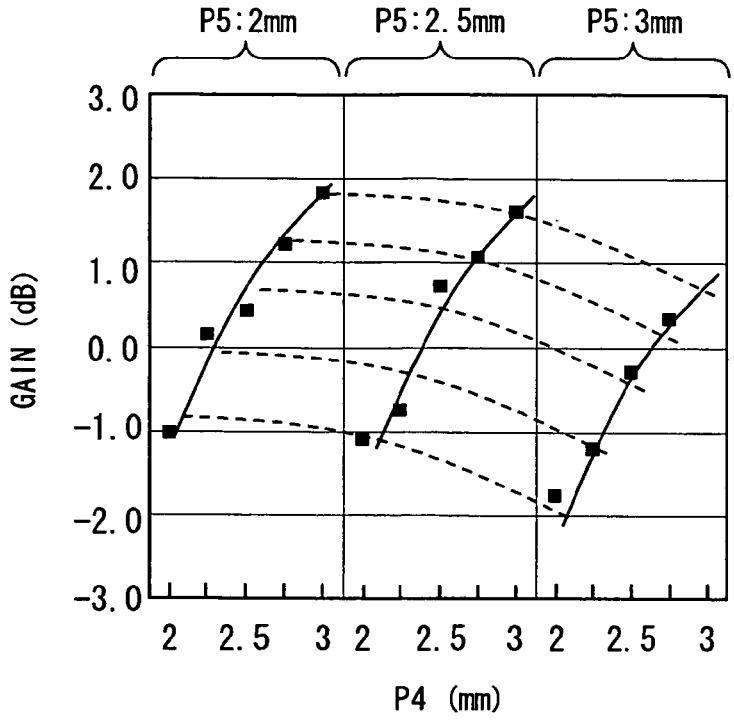
FIG. 9 is a graph showing a relation between the gain and spacings between helical portions of the antenna of FIG. 4A.

FIG. 9 is a graph showing dependence of the gain on each of the spacing P4 and the spacing P5. In FIG. 9, broken lines indicate the dependence of the gain on the spacing P5 under the condition that the spacing P4 is fixed to 2 mm, 2.25 mm, 2.5 mm, 2.75 mm, and 3 mm. In FIG. 9, solid lines indicate the dependence of the gain on the spacing P4 under the condition that the spacing P5 is fixed to 2 mm, 2.5 mm, and 3 mm.

As can be seen from the broken line in FIG. 9, the gain of the antenna 200 increases with a decrease in the spacing P5. Therefore, the gain of the antenna 200 can be increased by narrowing the spacing P5 within a range where the helical portions of the inner element 50 can be provided. It is preferable that the spacing P5 be less than the spacing P4 of the outer element 40. In such an approach, the gain of the antenna 200 can be increased if only the spacing P5 is taken into account, as compared to when the spacing P5 is greater than or equal to the spacing P4.

However, the electrical length decreases as the spacing P5 is narrowed. As a result, a self-resonant frequency of the antenna 200 falls. If the self-resonant frequency falls below a predetermined frequency (e.g., 312.15 MHz), a capacitor may be added to the antenna 200. In such approach, the self-resonant frequency of the antenna 200 can be adjusted to the predetermined frequency without a decrease in the gain.

As can be seen from the solid line in FIG. 9, the gain of the antenna 200 increases with an increase in the spacing P4. However, the electrical length also increases with the increase in the spacing P4. Because the inner diameter D4 of the outer element 40 is greater than the inner diameter D5 of the inner element 50, the electrical length of the antenna 200 greatly changes with the change in the spacing P4, as compared to the change in the spacing P5. Therefore, when the spacing P4 is greatly increased, the self-resonant frequency of the antenna 200 may exceed the predetermined frequency. In this case, an inductor for impedance matching is required. However, because the inductor has a resistive component, the gain of the antenna 200 may be reduced due to the resistive component.

The present inventors have compared the gain of the antenna 200 between when the self-resonant frequency falls below the predetermined frequency and the self-resonant frequency exceeds the predetermined frequency, under the condition that the inner diameter D5 is fixed to 3 mm.

Figure 10:
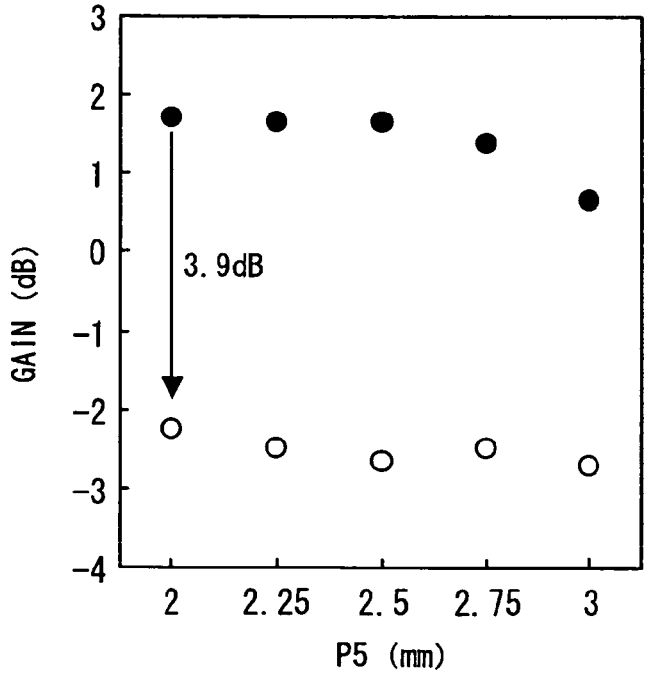
FIG. 10 is a graph showing a relation between the gain and a self-resonant frequency of the antenna of FIG. 4A.

In FIG. 10, filled circles indicate the gain measured when the spacing P4 of the outer element 40 is 3 mm, i.e., when the self-resonant frequency falls below the predetermined frequency. When the spacing P4 is 3 mm, the self-resonant frequency is about 300 MHz. Therefore, the antenna 200 is forced to resonate at the predetermined frequency by using the capacitor.

In FIG. 10, open circles indicate the gain measured when the spacing P4 of the outer element 40 is 3.5 mm, i.e., when the self-resonant frequency exceeds the predetermined frequency. When the spacing P4 is 3.5 mm, the self-resonant frequency is about 327 MHz. Therefore, the antenna 200 is forced to resonate at the predetermined frequency by using the inductor with an inductance of 12 nano henries (nH).

As can be seen from FIG. 10, the gain measured when the self-resonant frequency exceeds the predetermined frequency is less than the gain measured when the self-resonant frequency falls below the predetermined frequency by about 3.9 dB. Therefore, it is preferable that the spacing P4 of the outer element 40 be increased as much as possible within a range where the self-resonant frequency does not exceed the predetermined frequency and the helical portions of the outer element 40 can be provided. In such an approach, the gain of the antenna 200 can be increased if only the spacing P4 is taken into account.

The embodiments described above may be modified in various ways. For example, the antenna 200 may be used for various types of wireless devices including the vehicular keyless entry receiver. The antenna 200 may have a resonance frequency other than 312.15 MHz. The outer and inner elements 40, 50 may be formed from a wire having a diameter other than 1.2 mm by various forming processes.

What is claimed is:

1. An antenna for transmitting and receiving a radio wave having a predetermined wavelength, the antenna comprising:

an outer element including a first plurality of helical turns of a first diameter disposed along a central axis; and an inner element including a second plurality of helical turns of a second diameter also disposed co-axially along a common portion of said central axis, wherein:

said first diameter is larger than said second diameter sufficient to provide a predetermined spatial separation between said outer and inner elements;

the outer element and inner element being connected across an RF signal source, thus providing a balanced RF alternating current circuit having one side connected to said outer element and the other side connected to said inner element, such that the outer and inner elements alternately serve as signal and ground lines because of an RF current flowing through the outer and inner elements.

2. The antenna according to claim 1, wherein a total electrical length of the outer and inner elements is approximately equal to a half wavelength of a radio wave corresponding to an RF signal source frequency.

3. The antenna according to claim 1, wherein the outer element has a first height in a direction of the first axis, the inner element has a second height in the direction of the second axis, and the first height is approximately equal to the second height.

4. The antenna according to claim 1, wherein each of the first helical turns of the outer element has a first inner diameter, each of the second helical turns of the inner element has a second inner diameter, and a ratio of the second inner diameter to the first inner diameter is less than or equal to 0.6.

5. The antenna according to claim 4, wherein the ratio of the second inner diameter to the first inner diameter is less than or equal to 0.3.

6. The antenna according to claim 1, wherein a first spacing in an axial direction is provided between each of the first helical turns of the outer element, a second spacing in an axial direction is provided between each of the second helical turns of the inner element, and the second spacing is less than the first spacing.

7. The antenna according to claim 1, wherein a spacing is provided between each of the first helical turns of the outer element to allow the antenna to have a self-resonant frequency closest to a predetermined resonant frequency, and the self-resonant frequency is lower than or equal to the predetermined resonant frequency.

8. The antenna according to claim 1, further comprising:

a circuit board to which the outer and inner elements are fixed, wherein each of the outer and inner elements has one end portion electrically connected to circuits on the circuit board.

9. The antenna according to claim 1, in combination with a vehicular wireless device in which said antenna is incorporated.

* * * * *